United States Patent [19]

Elliott

[11] 4,407,030

[45] Oct. 4, 1983

[54] SAFETY DEVICE FOR AN ADJUSTABLE BED

[75] Inventor: Franklin E. Elliott, Torrance, Calif.

[73] Assignee: Maxwell Products, Inc., Cerritos, Calif.

[21] Appl. No.: 233,007

[22] Filed: Feb. 9, 1981

[51] Int. Cl.[3] ..... A61G 7/00

[52] U.S. Cl. ..... 5/66; 5/69

[58] Field of Search ..... 5/60, 63, 66–69; 192/150

[56] References Cited

U.S. PATENT DOCUMENTS

| | | | |
|---|---|---|---|
| 2,775,137 | 12/1956 | Chung | 192/150 X |
| 2,847,629 | 8/1958 | Schaeffer | 5/63 |
| 3,644,946 | 2/1972 | Swatt | 5/68 |
| 3,682,283 | 8/1972 | Sato | 192/150 X |
| 3,707,930 | 1/1973 | Yindra et al. | 192/150 X |
| 4,107,877 | 8/1978 | Lee | 192/150 X |
| 4,307,799 | 12/1981 | Zouzulas | 192/150 |
| 4,342,354 | 8/1982 | Leivenzon et al. | 192/150 |

*Primary Examiner*—William E. Lyddane
*Assistant Examiner*—Micheal F. Trettel
*Attorney, Agent, or Firm*—Poms, Smith, Lande & Rose

[57] ABSTRACT

A safety device for an adjustable bed having an articulated mattress is shown including a power drive module having adjustable sections that support corresponding sections of the articulated mattress. Multiple winding electrical motors are mounted within the drive module for driving the adjustable sections through linkages. Due to the weight of the articulated mattress and adjustable section, the linkages are always in tension. However, should a foreign object, such as a hand, be placed below the mattress supporting section as it is lowered, the linkage will be exposed to a compression force. A switch is mounted within the linkage to sense the compression force and inhibit the motor winding which lowers the bed. However, the winding which raises the adjustable bed continues to be enabled to permit the bed to be raised and the foreign object removed.

15 Claims, 4 Drawing Figures

SAFETY DEVICE FOR AN ADJUSTABLE BED

The present invention relates to an articulated adjustable bed, and more particularly, to a safety device which may be mounted within the bed to prevent the accidental lowering of the bed upon a foreign object, such as a child's hand.

BACKGROUND OF THE INVENTION

The use of adjustable beds has been known for sometime. Prior art adjustable beds were generally used in hospitals and convalescent homes and were adjusted by mechanical levers or cranks. Later, the mechanical devices were replaced by motors which drove the adjustable beds into the desired position through the use of gear trains, chain and sprocket drives, or threaded shafts. Many of these motor driven beds were equipped with limit switches to prevent the excessive raising or lowering thereof.

Several examples showing articulated adjustable beds which utilize limit switches may be found in the prior art including:

U.S. Pat. No. 2,349,701 by J. W. Buttikofer et al.;
U.S. Pat. No. 2,605,481 by A. L. Burkhart;
U.S. Pat. No. 2,714,092 by F. W. Marshall;
U.S. Pat. No. 2,747,203 by C. E. Dawson;
U.S. Pat. No. 2,807,174 by H. D. Helsel;
U.S. Pat. No. 2,837,751 by S. M. McCall;
U.S. Pat. No. 2,913,738 by C. W. Wise;
U.S. Pat. No. 3,051,965 by J. C. Szemplak et al.; and
U.S. Pat. No. 3,300,794 by H. Altorfer.

Each of these patents describes the use of a limit switch to prevent the burn out of a motor should the user of the bed attempt to exceed the physical limits of adjustment. None of the cited patents disclose a safety device which can sense the presence of a foreign object, such as a hand, under the bed and prevent the lowering of that bed.

SUMMARY OF THE INVENTION

Accordingly, it is an object of the present invention to provide a safety device for an adjustable bed.

Another object of the present invention is to provide a switch which inhibits the lowering of an adjustable bed should a foreign object, such as a hand, be placed in a position where it might be crushed by such lowering.

A further object of the present invention is to inhibit the lowering of an adjustable bed when it encounters a foreign object, while still enabling the raising of the bed in spite of the inhibiting action of a safety device.

In accomplishing these and other objects, there is provided an adjustable bed having several adjustable sections which support corresponding sections of an articulated mattress. Typically, an articulated mattress may include a head, seat, thigh and lower leg section. The mattress maybe supported upon a power drive module nested within a bed frame which includes four sections, three of which may be raised and lowered in order to adjust the mattress. The raising and lowering of the mattress is accomplished by electrical motors which are controlled by a hand held or bed mounted switch. As the motors are energized, they transmit their energy through suitable linkages to the adjustable sections of the drive module.

The linkages are subjected to a mechanical force caused by the weight of the adjustable sections, articulated mattress, and the person using the bed. This mechanical force may be a torsional force, tensional force or compressional force depending on the arrangement of the linkage. In any event, the linkage is continually exposed to this mechanical force until such time as a foreign object, such as the hand, is introduced into the linkage. As the adjustable bed is lowered upon a hand, for example, the force expected upon the linkage will undergo a change of state. A sensing element, such as a switch, is placed within the linkage to recognize this change of state and inhibit the motor drive.

The circuit wiring of the motor which energizes the adjustable bed incorporates the switching safety device. As the motor has at least two windings including one winding for raising the bed and one winding for lowering the bed, it is only necessary to interrupt or inhibit the winding for lowering the beds. In the preferred embodiment of the present invention, the winding for raising the bed remains enabled to permit adjustment of the bed to free the hand or other foreign object.

DESCRIPTION OF THE DRAWINGS

Other objects and further advantages of the present invention will become apparent to those skilled in the art after carefully considering the following specification and the accompanying drawings, wherein.

DESCRIPTION OF THE PREFERRED EMBODIMENT

Figure 1:
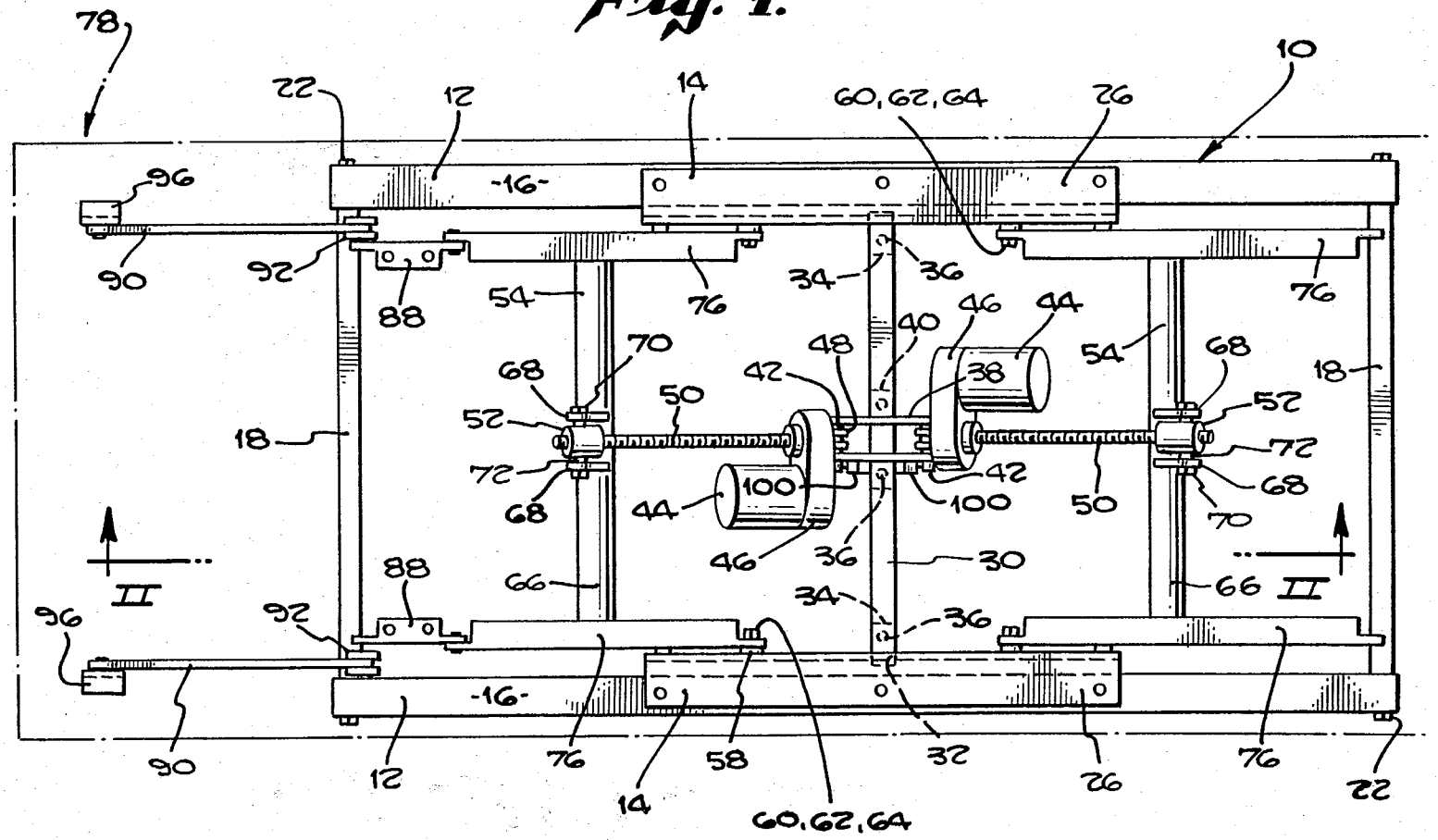
FIG. 1 is a top plane view of a power drive module and frame of an adjustable articulated bed incorporating the present invention.

Referring now to the drawings, FIG. 1 shows an adjustable articulated bed 10 including a frame 12 and a power module 14 nested within the frame. The frame consists of two longitudinal supports 16 joined by two cross supports 18 which are the equivalent of a headboard and footboard in prior art beds. The opposite ends of the longitudinal supports 16 are bent at right angles to form vertical, frame support legs 20, FIG. 2. The lower portion of the vertical legs 20 may be provided with sockets or other suitable means for mounting casters, not shown, which assists in moving the bed. Each cross support 18 is attached to the longitudinal supports 16 by suitable nuts and bolts, 22 and 24.

While the preferred embodiment of the safety device of the present invention will be described as mounted within the power drive module 14 that nests within the frame 12, it shall be understood that the present invention may be used in any suitable adjustable bed arrangement. The adjustable bed described herein is more fully described in a copending patent application entitled Adjustable Articulated Bed, by Franklin E. Elliott, Ser. No. 232,657 filed Feb. 9, 1981, and assigned to the same assignee as the present invention.

The power drive module 14 includes a pair of central support sections 26 that are L-shaped in cross section with the shorter legs thereof extending outwardly therefrom to land upon the longitudinal supports 16 of the frame 12. A tubular lateral support member 30 having a square cross section passes between the central support sections 26 for securing these sections in the power module 14 in a spaced, parallel relationship. The square cross section of the lateral support member 30 is inserted into a square aperture 32 found within each support member 26. In stamping the support members 26, the square aperture 32 is formed by a U-shaped stamp which bends the material removed at right angles to the surface of the support members to form tabs 34. The tabs 34 extends under the square cross section of lateral member 30 to support that member and align the central support sections 26 with that member. An aperture may be tapped in the support member 30 to receive a screw 36 for fastening each central support section 26 to the lateral member 30.

Mounted midway between the central support sections 26 are a pair of motor connecting plates 38 which have been stamped to produce a square aperture 39 whose material has been bent at a right angle to produce a tab 40 similar to tab 34. Again, the lateral support member 30 may be tapped to receive mounting screws 36 which secure the motor connectors 38 to the support member 30. The motor connectors 38 are stamped in the shape of a rhombus having apertures 41 at opposite ends through which a pin 42 may be inserted to pivotally mount motors 44. Each motor is provided with a gear train 46 having tabs 48 extending from its lower surface through which the pin 42 passes to provide the pivotal mounting. The gear trains 46 drive threaded shafts 50 which pass through threaded, low friction bushings 52 which may be made from a moldable, low friction material such as nylon.

Mounted to the lower outer corners of each of the central support sections 26 is one leg of an H-shaped torque arm 54. Each torque arm 54 is constructed from two triangularly shaped plates 56 whose inner end pivotally connects to the central support sections 26. The pivotal connection is accomplished by stamping a boss 58 into the central support section 26 to provide a raised anular surface against which the plate 56 may ride. The boss 58 is drilled to provide an aperture into which is inserted a shouldered stud 60 which is retained therein by welding. The plate 56 is drilled to provide a larger aperture which receives a pair of shouldered, low friction bushings 62 through which the shouldered stud 60 is inserted so that the shoulders of bushings 62 assure the separation of the plate 56 from the boss 58. A self-locking flange nut 64 retains the plate 56 in place.

Between each plate 56 is welded a cross member 66 to complete the H-shaped torque arm subassembly. Extending perpendicularly from the center of the cross member 66 are a pair of bushing mounting tabs 68 which may be welded to the cross member 66 and which are provided with threaded apertures for receiving shouldered bolts 70 each having a reduced shouldered portion 72 that slidably fit into apertures within the side wall of the bushing 52 to pivotally retain the bushing 52 between tabs 68.

Connected to the outer end of the triangular plates 56 which form the H-shaped torque arms 54 are a pair of upwardly extending pivot arms 74 which are pivotally attached to the plate 56 by use of the stud 60, bushing 62 and flange nut 64 as described above. Similarly, a pair of horizontal support members 76 are pivotally mounted about bosses 58 located in the upper, outer corners of the central support sections 26 by the use of the stud 60, bushing 62 and flange nut 64. In the positions shown, the horizontal support members 76 extend parallel with the central support sections 26. Pivotally connected to the horizontal support members 76 are the pivot arms 74 which are attached by the stud, bushing and jam nut 60, 62 and 64, respectively.

It will be seen from the foregoing description that the structural elements attached to each end of the central support section 26 form a parallelogram which may be raised when either motor 44 is energized for rotating the threaded shaft 50. Rotation of the threaded shaft 50 causes the busing 52 to move along the longitudinal axis of the shaft 50 for rotating the H-shaped torque arm 54 about the pivot point located at the lower, outer ends of the central support sections 26. This causes the structural parallelogram formed by the members 56, 74 and 76 to rotate in an upward or downward direction with the members 56 and 76 remaining generally parallel to one another while the member 74 remains generally parallel to a line drawn between the pivot points located in the upper and lower corners of the central support sections 26.

The structural parallelograms thus described are found at the four corners of the power drive module 14 formed by the two central support sections 26 so that each moving section of the power module 14 is supported by two structural parallelograms. This provides added strength to the articulated bed.

Figure 2:
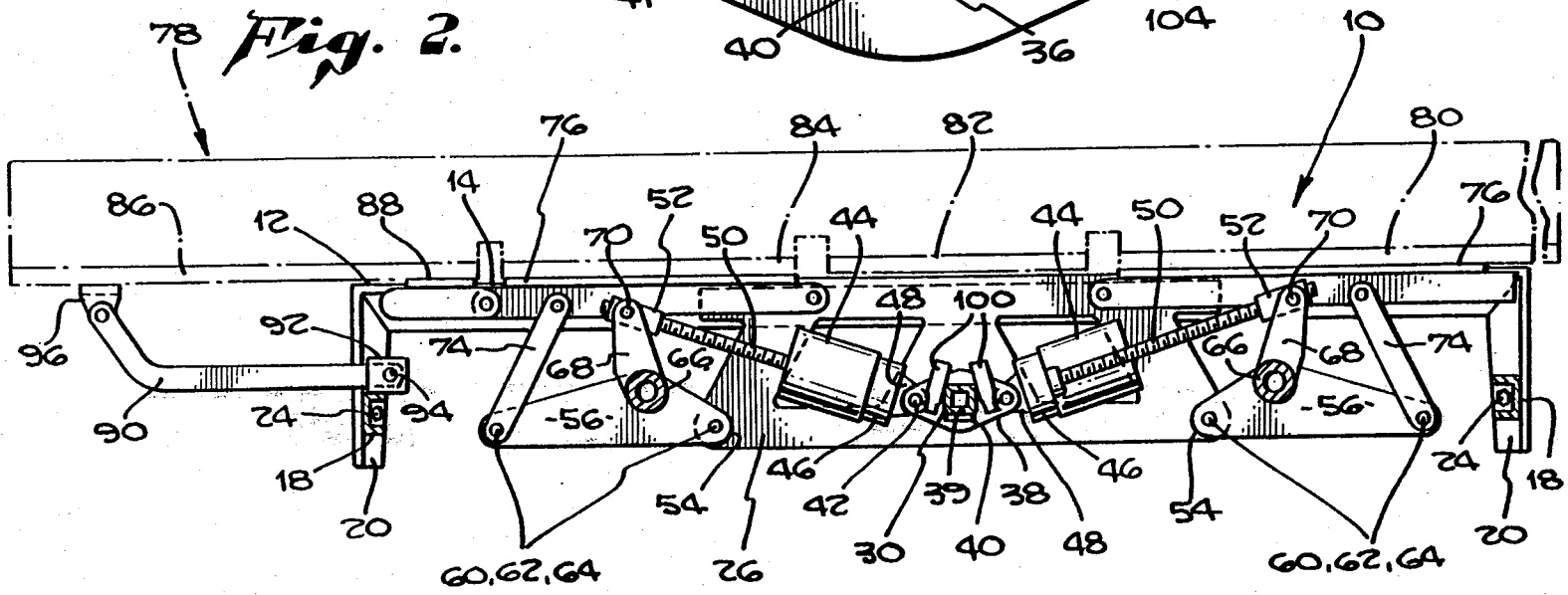
FIG. 2 is a cross sectional view of the power drive module taken along line II—II of FIG. 1 but further showing an articulated mattress.

As seen in FIG. 2 an articulated mattress 78 may be formed from a plurality of sections. In the embodiment shown, the mattress is divided into four such sections including a back section 80, center section 82, thigh section 84 and lower leg section 86. The center section 82 mounts upon the center support sections 26 and is secured thereto by suitable screws, not shown. Similarly, the back section 80 mounts upon the right-hand horizontal support members 76 and is secured thereto by screws to form a back raising section while the thigh section 74 mounts upon the left-hand horizontal support members 76 that form the leg rising section of the power drive module 14.

As seen in FIGS. 1 and 2, the lower leg section 86 of the mattress is supported by a hinge 88 which is pivotally attached to the outer and of the left-hand horizontal support member 76. This hinge is secured to the lower leg section 86 of the mattress 78, by screws, not shown. The far end of the lower leg section 86 is supported by a pair of J-shaped pivotal linkages 90 that are removably mounted upon the cross support 18 of the frame 12 by a U-shaped hinge element 92 which receives the pivotal linkages 90 between the upwardly extending legs thereof and retains them by the use of hinge pins 94. An L-shaped pivot hinge 96 mountes at the end of the short leg of each J-shaped linkage to attach the outside edge of the mattress section 86 for completing the assembly of the articulated bed.

From reviewing FIGS. 1 and 2, it will be apparent that adjustment of the articulated bed 10 exposes large openings into which a child could insert his or her hand, arm or foot. It the user of the bed were lowering the bed, the action could catch the appendage of an unwary person and cause considerable harm before the user realized what was happening. Accordingly, the present invention provides a safety device 100 which enables the operation of the motors 44 during normal condition. Should someone inadvertently place an appendage between the frame 12 and the power module 14, the safety device will sense the presence of that foreign object and disable the motors 44.

Figure 3:
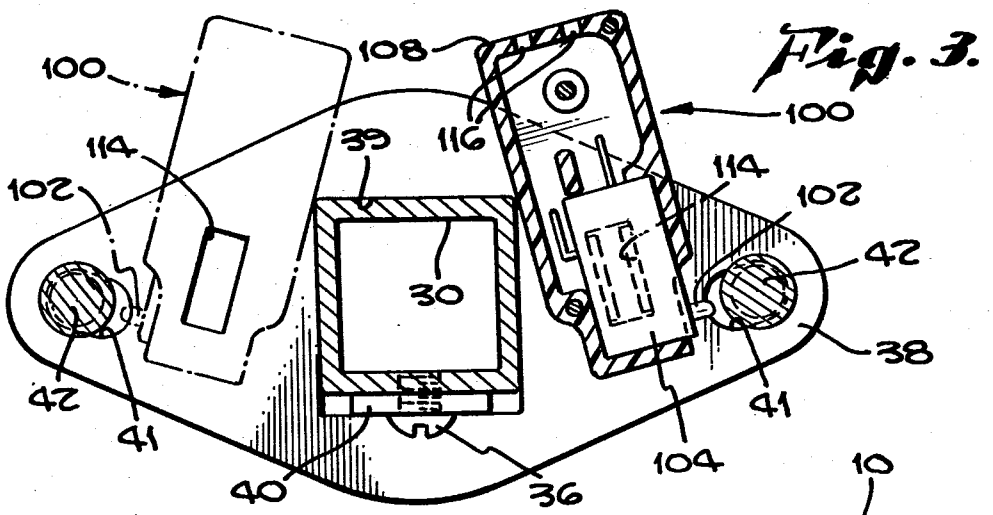
FIG. 3 shows the mounting of the safety device of the present invention in greater detail.

Referring now to FIG. 3, the safety device 100 is shown in greater detail. It will be noted that the heads of the pins 42 are enlarged to retain those pins in slotted apertures 41. As seen in FIG. 2, the weight of the mattress 78 and adjustable sections which raise and lower the head section 80 and lower leg section 86 of the mattress place a force upon the horizontal members 76. This force has a tendancy to push the plates 56 in a direction which tends to pull the bushings 52 away from the threaded shaft 50. Therefore, the force placed upon the shafts 50 is a tensional force. This tensional force pulls the motor 44 away from its mounting plate 38 and urges the pin 42 into the outer most end of the slot 41.

Should an individual inadvertently place his or her hand, for example, between the frame 12 and the mattress 78 when the mattress is in a raised condition, the inadvertent movement would normally cause no harm. However, should the user of the mattress be lowering it at the same time that a hand was inserted, the hand could be caught, for example, between the head section 80 of mattress 76 and the frame 12. In this position, the weight of the mattress and supporting section will be born upon the hand. When this happens, the torsional force within the threaded shaft 50 converts to a compressional force. As the shaft 50 undergoes compression, it forces the motor 44 back against its mounting plate 38 and causes the pin 42 to move in an inward direction toward the inner end of slot 41.

As the pin 42 moves, it contacts an actuator 102 on a switch 104. Actuation of switch 104 causes the electrical power supplied to the motor 44 to be interrupted for disabling the motor. In the preferred embodiment, the motors 44 have at least two windings. The first windings rotate the motors in one direction for causing the shafts 50 to rotate in a direction that draws the bushings 52 toward the motors 44 for raising the mattress sections 80, 84 and 86. The second windings rotate the motors in the opposite direction for lowering the mattress sections. Thus, the switch 104 is arranged to only interrupt the electric power supplied to the second winding of the motors 44 to inhibit lowering. In this way, the user of the bed may still activate the first winding for raising the bed. The wiring arrangement makes it impossible for the user to panic and push the wrong button thus lowering the bed further upon the hand inadvertently placed between the mattress section 80 and frame 12.

Figure 4:
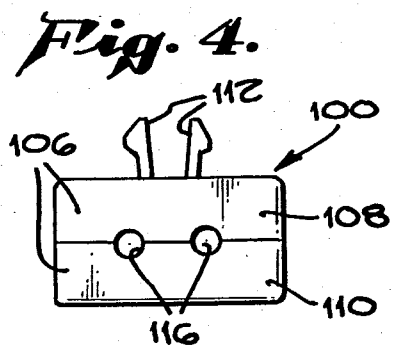
FIG. 4 is an end view of the housing mounting the safety device shown in FIG. 3.

It will be seen in FIG. 4, that the switch 104 is mounted within a molded housing 106 formed from a lower, switch mounting base 108 and an upper, housing cover 110. The lower base 108 has a pair of elongated, clip-like legs 112 molded into its lower surface which snap into a rectangular aperture 114 stamped into the plate 38. Thus, a pair of safety devices 100 may be mounted on either side of the plate 38 for sensing the presence of a foreign object under either the right or left hand section of the articulated adjustable bed. In FIG. 3, but one device 100 is shown while the second device is shown in phantom to demonstrate the aperture 114.

The housing 108 and 110 may be made from a molded plastic to provide electrical insulation between the adjustable bed 10 and switch 104. The upper most edge of the base housing 108 is provided with a pair of apertures 116 through which wires from the switch 104 may be passed. When the cover 110 is snapped onto the base 108, the apertures 116 provide an outlet for the wires, not shown, with a strain relief. The aperture 114 conveniently and accurately locates the safety device 100 and its switch 104 in the proper position. Once the switch has been assembled, it is possible to attach the cover 110 to base 108 by high frequency welding or by bonding.

In operation, the safety device 100 functions to prevent the further lowering of the adjustable bed 10 when a foreign object is placed underneath the mattress and between the frame. While the safety device of the present invention has been shown mounted within an adjustable articulated bed similar to the one described in a copending patent application entitled Adjustable Articulated Bed by Franklin E. Elliott, identified hereinabove, it will be understood that the safety device may be used in any articulated bed in which the mechanical linkage between the motor and the bed undergoes a change of mechanical force.

For example, the arrangements shown in FIGS. 1 and 2 demonstrate a linkage including the threaded shaft 50 which is in tension. When a hand is inserted between the mattress 78 and the frame 12, the threaded shaft 50 is placed in compression for activating switch 104. In other prior art arrangements, it is not uncommon to utilize a motor and a threaded shaft, such as shaft 50, to push the mattress into a raised position. In this arrangement, the linkage would be under compression during normal operations and then be placed in tension only when a foreign object was inserted between the mattress and the frame. Therefore, the present invention should not be limited by the type of force which is normally applied to the mechanical linkage. Nor should the present invention be limited to adjustable articulated beds using one, two or more motors, or to motors with one or more windings. Accordingly, the present invention should be limited only by the appended claims.

I claim:

1. A safety device for an adjustable bed comprising:
means for adjusting said bed including linkage means subjected to a mechanical force;
an electric motor for driving said linkage means;
a connector plate for connecting said motor to said adjustable bed; and
a sensing element mounted upon said connector plate for engaging said electrical motor and for undergoing a change of state as said mechanical force applied to said linkage means undergoes a change of state, whereby said motor is disabled upon a change of said mechanical force.

2. A safety device for an adjustable bed, as claimed in claim 1, wherein:
said mechanical force applied to said linkage means is normally a tensional force and said change of state is a change to a compressional force; and
said sensing element is a switch.

3. A safety device for an adjustable bed, as claimed in claim 1, wherein:
said mechanical force applied to said linkage means is normally a compressional force and said change of state is a change to a tensional force; and
said sensing element is a switch.

4. A safety device for an adjustable bed, as claimed in claim 1, wherein:
said sensing element includes a switch which normally enables the operation of said motor while said linkage means is subjected to said mechanical force and disables said operation when said linkage means undergoes a change of state.

5. A safety device for an adjustable bed, as claimed in claim 4, wherein:
said switch enables the operation of said motor when said linkage means is subjected to a tensional force and disables said motor when said linkage means is subjected to a compressional force.

6. A safety device for an adjustable bed, as claimed in claim 4, wherein:

said switch enables the operation of said motor when said linkage means is subjected to a compressional force and disables said motor when said linkage means is subjected to a tensional force.

7. A safety device for an adjustable bed, as claimed in claim 4, wherein:

said electric motor has more than one winding; and said switch disables the operation of at least one winding when said mechanical force upon said linkage means undergoes a change of state.

8. A safety device for an adjustable bed, as claimed in claim 4, wherein:

said motor has a winding for raising and a winding for lowering said adjustable bed through said linkage means;

said adjustable bed places said mechanical force upon said linkage means as it is raised and lowered;

said linkage means is subjected to said change of state of said mechanical force when a foreign object interferes with said lowering of said adjustable bed; and said switch disables said motor winding for lowering said bed when said linkage means is subjected to change of state of said mechanical force to prevent further lowering of said adjustable bed and further damage of said foreign object.

9. A safety device for an adjustable bed, as claimed in claim 8 wherein:

said switch retains said motor winding for raising said bed in an operative state to permit the raising of said adjustable bed and removal of said foreign object before said foreign object can be damaged further.

10. A safety device for an adjustable bed having an articulated mattress, comprising:

linkage means for raising and lowering portions of said articulated mattress;

motor means for driving said linkage means under an adjusting force;

a connector plate for connecting said motor means to said adjustable bed; and switching means mounted upon said connector plate to sense a change of state of said adjusting force and to inhibit said motor means upon sensing said change.

11. A safety device for an adjustable bed, as claimed in claim 10, wherein:

said adjusting force is a tensional force and said change of state of said adjusting force is a change to a compressional force.

12. A safety device for an adjustable bed, as claimed in claim 10, wherein:

said adjusting force is a compressional force and said change of state of said adjusting force is a change to a tensional force.

13. A safety device for an adjustable bed, as claimed in claim 10, wherein:

said motor means has more than one winding for raising and lowering said adjustable bed; and said switching means inhibits said winding for lowering said adjustable bed when said switch senses a change of state of said adjusting force while retaining said winding for raising said adjustable bed in an operative condition.

14. A safety device for an adjustable bed, comprising:

means for adjusting said bed including linkage means subjected to a mechanical force;

an electric motor for driving said linkage means;

a connector plate for connecting said motor to said adjustable bed;

a sensing element mounted upon said connector plate for engaging said electrical motor and for undergoing a change of state as said mechanical force applied to said linkage means undergoes a change of state;

housing means for receiving said sensing element having yieldable legs extending therefrom; and said connector plate having an aperture therein for receiving said yieldable legs and mounting said sensing element upon said connector plate.

15. A safety device for an adjustable bed, comprising:

means for adjusting said bed including linkage means subjected to a mechanical force;

an electric motor for driving said linkage means;

a connector plate for connecting said motor to said adjustable bed;

a sensing element mounted upon said connector plate for engaging said electrical motor and for undergoing a change of state as said mechanical force applied to said linkage means undergoes a change of state;

said connector plate having a slotted aperture therein with first and second ends;

pin means passing through said slotted aperture for connecting said motor to said connector plate, said pin means normally retained at said first end of said slotted aperture under the urging of said mechanical force;

said sensing element mounted upon said connector plate to engage said pin means at said second end of said slotted aperture as said mechanical force undergoes a change of state, wherein said pin means engage said sensing element under the urging of said change of state of said force to disable said electric motor.

* * * * *